US008701563B2

(12) United States Patent
Hinteregger

(10) Patent No.: US 8,701,563 B2
(45) Date of Patent: Apr. 22, 2014

(54) FOOTREST AND METHOD OF OPERATING A CHAIRLIFT

(75) Inventor: Christoph Hinteregger, Wolfurt (AT)

(73) Assignee: Innova Patent GmbH, Wolfurt (AT)

( * ) Notice: Subject to any disclaimer, the term of this patent is extended or adjusted under 35 U.S.C. 154(b) by 192 days.

(21) Appl. No.: 13/273,698

(22) Filed: Oct. 14, 2011

(65) Prior Publication Data

US 2012/0090500 A1 Apr. 19, 2012

(30) Foreign Application Priority Data

Oct. 14, 2010 (AT) ..... A 1710/2010

(51) Int. Cl.
*B61B 12/00* (2006.01)

(52) U.S. Cl.
USPC ..... 105/149.2

(58) Field of Classification Search
USPC ..... 105/149.1, 149.2; 297/423.26, 423.28, 297/423.29, 423.3; 104/173.2, 241
See application file for complete search history.

(56) References Cited

U.S. PATENT DOCUMENTS

| | | | | |
|---|---|---|---|---|
| 2,662,587 A * | 12/1953 | McIlvaine | ..... | 297/411.32 |
| 2,710,650 A | 6/1955 | Sowder | | |
| 4,509,798 A * | 4/1985 | Strothers | ..... | 297/487 |

FOREIGN PATENT DOCUMENTS

| | | | | |
|---|---|---|---|---|
| AT | 183 106 B | 9/1955 | | |
| DE | 2 131 456 | 12/1971 | | |
| FR | 2 094 617 A5 | 2/1972 | | |
| JP | 60-085272 U | 6/1985 | | |
| JP | 03148368 A * | 6/1991 | ..... | B61B 13/06 |

OTHER PUBLICATIONS

Austrian Patent Office, Office Action Dated Aug. 8, 2011.

* cited by examiner

*Primary Examiner* — Mark Le
(74) *Attorney, Agent, or Firm* — Laurence A. Greenberg; Werner H. Stemer; Ralph E. Locher

(57) ABSTRACT

A chair of a chairlift contains a footrest which is connected to an automatic positioning mechanism and which may be positioned below the seat of the chair between a travel position and a boarding and/or disembarking position. The chair further has at least one seat with a seat surface and a safety bar extending transversely over the seat and being pivoted from an open position into a closed position.

30 Claims, 10 Drawing Sheets

FOOTREST AND METHOD OF OPERATING A CHAIRLIFT

CROSS-REFERENCE TO RELATED APPLICATION

This application claims the priority, under 35 U.S.C. §119, of Austrian application A 1710/2010, filed Oct. 14, 2010; the prior application is herewith incorporated by reference in its entirety.

BACKGROUND OF THE INVENTION

Field of the Invention

The invention relates to a chair of a chairlift containing at least one seat with a seat surface, a safety bar which extends transversely over the seat and which may be pivoted from an open position into a closed position, and at least one footrest.

The invention further relates to a method for operating a chairlift in which chairs containing at least one seat with a seat surface are moved from one terminal to another terminal and in which a safety bar is pivoted in a terminal between an open position and a closed position.

Chairs for chairlifts contain at least one seat, often two, three or four but even up to eight or more, for example ten, adjacent seats, a footrest being assigned to each seat, and on which the passengers are able to place and rest their feet, optionally with skis or a snowboard fastened thereto (for example see Austrian patent AT 411 523 B (corresponding to U.S. Pat. No. 6,712,001) and AT 411 046 B (corresponding to U.S. patent publication No. 20090275662)). The footrests are rigidly fastened to the safety bar of the chair via support bars which extend downward from the safety bar in front of the seats. The footrests themselves consist of bars or tubes protruding to the side away from the support bar, and which are fastened to the lower end of the support bars and are brought into the boarding and/or disembarking position by pivoting the safety bar.

A problem with pivoting the safety bar is that the support bar on which the footrest is arranged may cause a leg of a passenger to become caught when the passenger is not in the correct seating position. This problem is critical when the passenger wishes to correct the seating position as then there is the risk that he/she slips from the seat. It is also possible that the passenger has to remain in an uncomfortable seating position when this is not able to be corrected.

Solutions in which a passenger closes the safety bar himself/herself, after being in a correct seating position, are disadvantageous as there is the risk that the safety bar is closed too late. Additionally, in the region of a terminal the passenger has to be able to concentrate fully on correctly boarding and/or disembarking. The correct boarding and disembarking of passengers is an important safety aspect within a chairlift terminal and during the entire journey from one terminal to another, as the safety measures provided by the manufacturer are at their most effective when passengers behave in the correct manner.

SUMMARY OF THE INVENTION

It is accordingly an object of the invention to provide a footrest and a method of operating a chairlift which overcome the above-mentioned disadvantages of the prior art methods and devices of this general type.

With the foregoing and other objects in view there is provided, in accordance with the invention a chair of a chairlift.

The chair contains at least one seat having a seat surface, a safety bar extending transversely over the seat and being pivoted from an open position into a closed position, an automatic positioning mechanism, and at least one footrest connected to the automatic positioning mechanism and being adjusted below the seat between a travel position and a boarding/disembarking position.

As the footrest according to the invention is adjusted by an automatic positioning mechanism and below the seat between a travel position and a boarding and/or disembarking position, there is no longer the risk that a leg of a passenger becomes caught, the passenger not having to dispense with a footrest and also not having to worry about closing the safety bar and positioning the footrest, so that he/she is able to concentrate entirely on boarding and disembarking. Moreover, when boarding and disembarking, the closing and opening of the safety bar and the positioning and the removal of the footrest may be chronologically separated from one another. In other words, when boarding, the safety bar is able to be closed first and only later is the footrest able to be positioned and, when disembarking, the footrest is able to be moved away when the safety bar is still closed.

According to the invention it is particularly preferred if, before reaching the travel position, the footrest is able to be moved with a movement component which is oriented vertically upward. Preferably, the footrest may be moved from the boarding and/or disembarking position with a movement component which is oriented vertically downward and which, toward the travel position, merges with a movement component which is oriented vertically upward. As the footrest, when being positioned into the travel position from the underside of a ski, snowboard or the like, is moved closer thereto, the footrest is prevented from being able to press onto the upper face of the sports equipment.

In a preferred embodiment, a positioning mechanism is arranged on the chair and a tripping device is arranged in the region of a chairlift terminal. Within the scope of the invention the positioning mechanism is able to be connected, in particular, to a guide roller which is raised and/or lowered when, in the region of a terminal, the chair passes through a region with a guide device assigned to the guide roller. The guide device may, for example, be a guide rail as the tripping device and drive for the positioning device.

Within the scope of the invention the tripping of the positioning device may also take place wirelessly. For example, a sensor may be provided as a tripping device.

In a further preferred embodiment, the positioning mechanism may be connected to a mechanism for opening and closing the safety bar and/or for pivoting the seat surface. Thus it may be ensured in a simple manner by the manufacturer that a plurality of safety measures are implemented at the same time.

Within the scope of the invention, the positioning mechanism may contain at least one motor, in particular an electric motor. In this case, in the region of a terminal, the tripping device may also be an electric signal transmitter for the motor. If an electric motor is used, the electric motor may be operated by a preferably rechargeable battery, which is charged up outside the operating time of the chairlift and/or when the chair passes through a terminal.

If the battery is intended to be charged up when passing through a terminal, the battery may be directly connected to a current collector which is arranged on the clamping body or the suspension bar of each chair. When entering a cableway terminal, the current collector comes into contact with a contact device provided in the cableway system, so that the battery may be charged up. The current collector may have both rolling contacts and sliding contacts, which cooperate with a contact device in the terminal which is correspondingly designed in each case. This contact device is preferably configured as a conductor rail which is arranged along the conveyor cable and/or cable pull of the cableway system. The energy may also be transmitted in a contactless manner in the form of an inductive coupling. In this case, by a corresponding device along the cable pull an electrical alternating field may be created which is received by a corresponding device of the chair and serves for charging up the battery.

In a purely mechanical positioning mechanism, the mechanism may exert a tensile force on the footrest, for example by a cable, and/or a compressive force, for example by a rod arrangement. In a positioning mechanism operated by a motor, cables or rods do not necessarily have to be provided for exerting tensile and/or compressive force on the footrest.

In one embodiment of the invention, a spring-loading device may be tensioned when moving the footrest from the travel position into the boarding and/or disembarking position and the footrest may be subsequently moved by the spring-loading device from the boarding and/or disembarking position into the travel position. As a spring-loading device, for example, a mechanical spring or pressure-medium cylinder may be used which is tensioned when the chair travels into the terminal, while the footrest is moved from the travel position into the boarding and/or disembarking position. The stored energy may subsequently be used in order to move the footrest from the boarding and/or disembarking position into the position. Naturally, this may alternatively be carried out in reverse by the spring-loading device being tensioned when the chair travels out of the terminal and the stored energy being used in order to move the footrest from the travel position into the boarding and/or disembarking position. For tensioning the spring-loading device, the mechanism may, for example, be coupled to a guide rail in or upstream of the terminal as is already known per se, for example, from the automatic opening and closing of the safety bar or the protective covers of chair lifts. For triggering the spring-loading device, therefore, it is only necessary to release a lock of the spring-loading device, which for example may take place mechanically or wirelessly and/or electrically.

According to the invention it may, in particular, be provided that the footrest is arranged in the travel position in the region below the front edge of the seat surface and in the boarding and/or disembarking position in the region of the rear edge of the seat surface. Within the scope of the invention, the footrest may be also arranged in the region below the seat surface and/or behind the backrest in the boarding and/or disembarking position.

In the travel position, i.e. when passengers position and rest their feet, optionally with skis or a snowboard fastened thereto, on the footrest, the footrest may be held in position by at least one tension rod. In embodiments of the chair according to the invention, in which the positioning mechanism per se remains in position in a sufficiently stable manner, no additional struts have to be provided.

The footrest may, for example, be a crossbeam which extends either at least partially over the width of a seat or substantially over the entire width of the chair. Within the scope of the invention, footrests which are of different design, for example plate-shaped footrests, may also be used.

Other features which are considered as characteristic for the invention are set forth in the appended claims.

Although the invention is illustrated and described herein as embodied in a footrest and a method of operating a chairlift, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1, 1A, 1B, 1C, 1D, 1E:
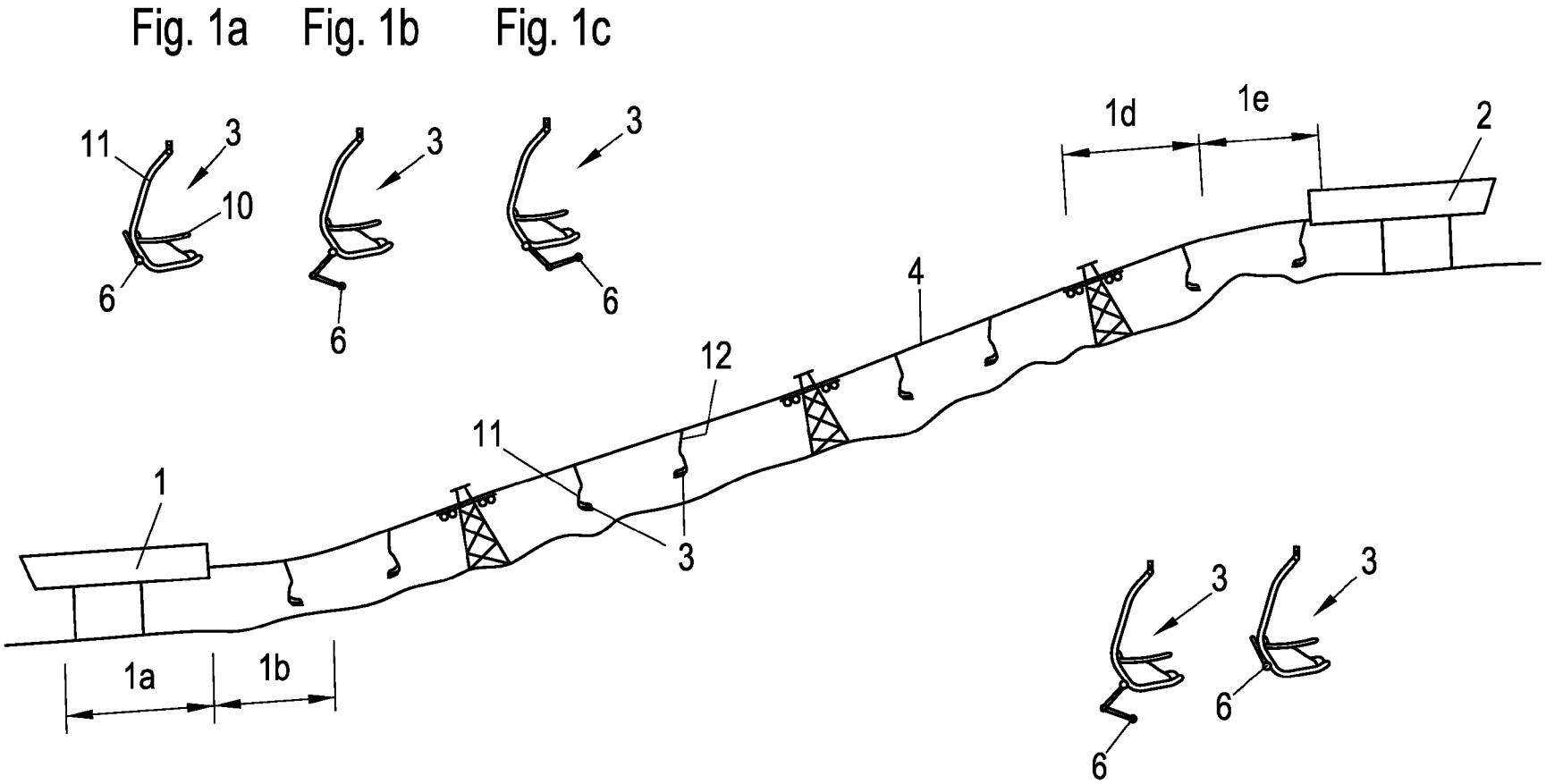
FIG. 1 is an illustration of a chairlift installation with two terminals.
FIGS. 1A to 1C are illustrations showing a movement sequence when positioning a footrest according to the invention when leaving a terminal.
FIGS. 1D and 1E are illustrations showing the movement sequence when pulling back a footrest according to the invention when entering a terminal.

Referring now to the figures of the drawing in detail and first, particularly, to FIG. 1 thereof, there is shown a chairlift installation containing a first terminal 1 and a second terminal 2, between which chairs 3 are moved on a conveyor cable 4. The chairs may be connected to the conveyor cable 4 in a fixedly clamped manner or by being able to be coupled thereto.

If a passenger in the first terminal 1 is seated on a seat 5 of a chair 3, a footrest 6 is in its boarding position on a rear face of the chair 3 (FIG. 1A and region 1*a* in FIG. 1). During or shortly after leaving the first terminal 1 the footrest 6 is then pivoted below the seat 5 (FIG. 1B and region 1*b* in FIG. 1) until it adopts a travel position shown in FIG. 1C, in which a passenger rests his/her feet or sports equipment thereon. The footrest 6 then remains in the travel position until the chair 3 reaches an entrance region of the second terminal 2. In the entrance region of the second terminal 2, the footrest 6 is then pivoted back below the seat 5 (FIG. 1D and region 1*d* in FIG. 1) until it adopts the disembarking position in which the footrest 6 is again arranged on the rear face of the chair 3. In the disembarking position (FIG. 1E and region 1*e* in FIG. 1) which corresponds to the boarding position, the passenger is able to disembark from the chair 3 in the second terminal 2 and a new passenger is able to climb into the chair 3.

In FIGS. 2 to 7, the chair 3 is shown with the footrest 6 according to the invention obliquely from the rear. The chair 3 has four seats 5, in each case with a seat surface and a backrest 7, the seat surface having a rear edge 8 assigned to the backrest 7 and a front edge 9 opposing the rear edge 8. Additionally, the chair 3 has a safety bar 10 which extends transversely over the seat 5 and may be pivoted from an open position into a closed position.

The remaining parts except for the footrest 6 may be configured in the conventional manner as in the prior art. Therefore, it is only mentioned in a general manner and by way of example that the safety bar 10 is arranged on a frame 11 which is connected to a support bar 12 via a joint, on the upper end thereof a clamping device being attached for fastening the chair 3 to the conveyor cable 4. The invention may be used for all configurations of chairs.

In the embodiment shown in FIGS. 2 to 7, the footrest 6 is a crossbeam which extends substantially over the entire width of the chair 3. On the crossbeam two side parts 6*a*, 6*b* are arranged which are connected via joints 13 to parallel pivotable rods 14 which are arranged via joints 15 on the chair 3. On the side parts 6*a*, 6*b* of the footrest 6 struts 16 which additionally fix the footrest 6 in its travel position are arranged in an articulated manner. Within the scope of the invention, the struts 16 may also be arranged on the pivotable rods 14. Preferably, however, the struts 16 are arranged as close as possible to the footrest 6, as the loads from the passengers supported on the footrest 6 may be received there in the best possible manner.

The footrest 6 and the side parts 6*a*, 6*b* form a U-shaped half-frame. Within the scope of the invention, the pivotable rods 14 may also be parts of a U-shaped frame with the two parallel rods and a transverse rod. On this U-shaped pivotable frame 14, the footrest 6 may be arranged as shown. Alternatively, it is possible that more than one footrest, for example in the form of a T-shaped rod, is arranged on the U-shaped pivotable frame 14. For each seat 5, therefore, one footrest may be provided, for example, the rod coming from a transverse rod of the U-shaped pivotable frame 14 extending centrally below the seat 5 in the travel position and when viewed in the travel direction. The footrest arranged thereon in the form of the T-shaped crossbeam extends to a maximum extent over the length of the front edge 9 of the seat 5. It is also possible for one footrest to be provided for two respective seats, the rod coming from the transverse rod of the U-shaped pivotable frame 14 extending between two seats 5 in the travel position and viewed in the direction of travel. The footrest arranged thereon extends therefore, for example, from the center of the one adjacent seat 5 to the center of the other adjacent seat 5.

Figure 2:
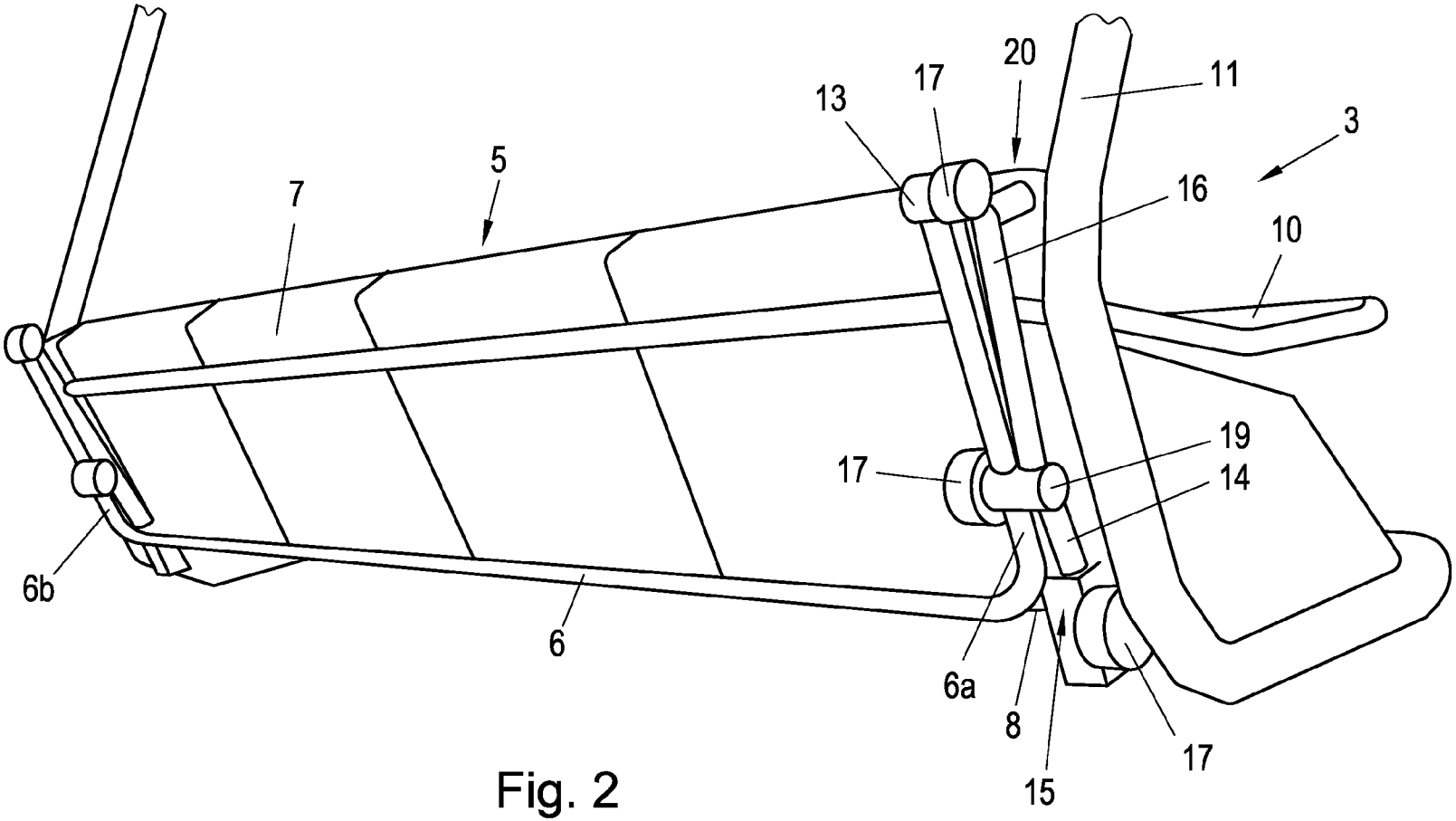
FIGS. 2 to 7 are diagrammatic, perspective views showing the movement sequence in detail when positioning the footrest according to the invention.
Figure 3:
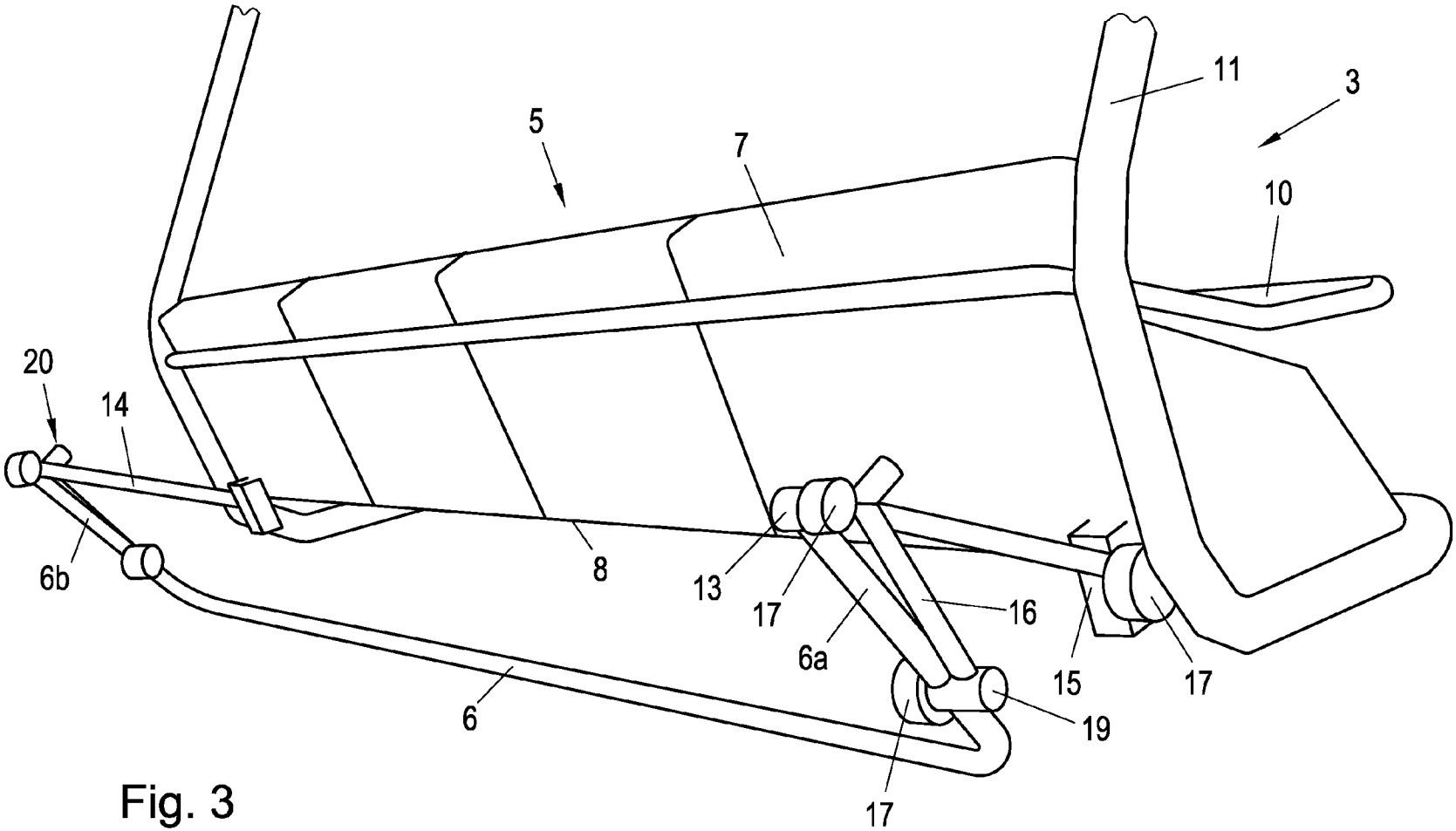

The boarding and/or disembarking position of the footrest 6 similar to FIGS. 1A and 1E is shown in FIG. 2. In this position, in which the safety bar 10 is arranged in an open position above the seat 5, the footrest 6 and the pivotable rods 14 are located on the rear face of the backrest 7, the crossbeam serving as the footrest 6 being arranged in the region of the rear edge 8 of the seat surface. The planes defined by the pivotable rods 14 and by the side parts 6*a*, 6*b* and the crossbeam extend substantially parallel to the surface of the backrest 7. The struts 16 are located in their initial position in which they are located substantially parallel (at an angle of approximately 10°) to the side parts 6*a*, 6*b* of the footrest 6.

When the chair 3 moves out of the terminal 1, the footrest 6 is automatically pivoted by a positioning mechanism 17, as shown in FIGS. 3 to 7. In the exemplary embodiment shown according to FIGS. 2 to 7 the positioning mechanism 17 contains electric motors which are arranged in the region of the joint connections 13, 15, 19 between the chair 3 and the pivotable rods 14, between the pivotable rods 14 and the side parts 6*a*, 6*b* and between the side parts 6*a*, 6*b* and the tension rod 16. The pivoting of the footrest 6 is carried out partially to the rear, but substantially below the seat 5.

Figure 4:
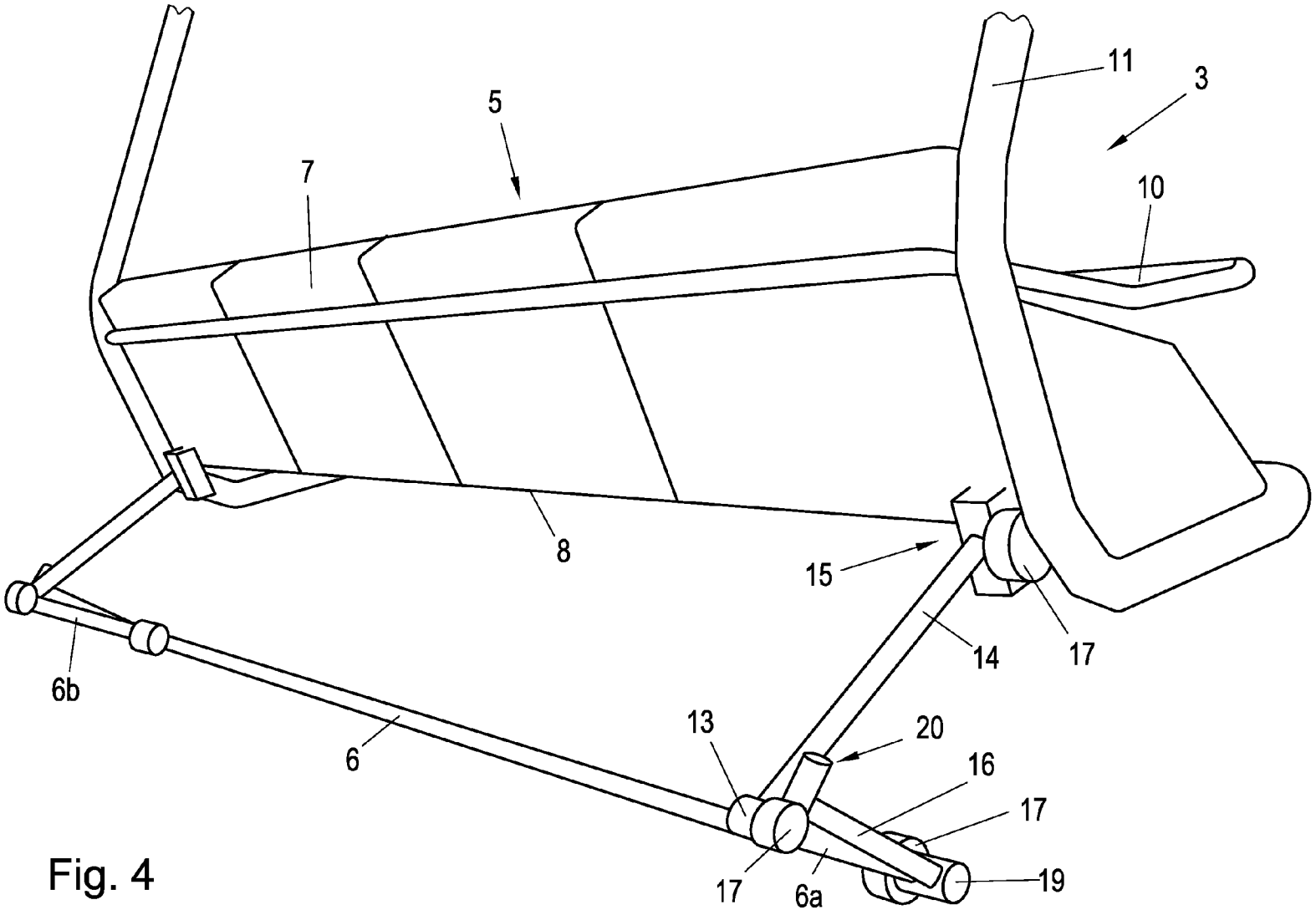
Figure 5:
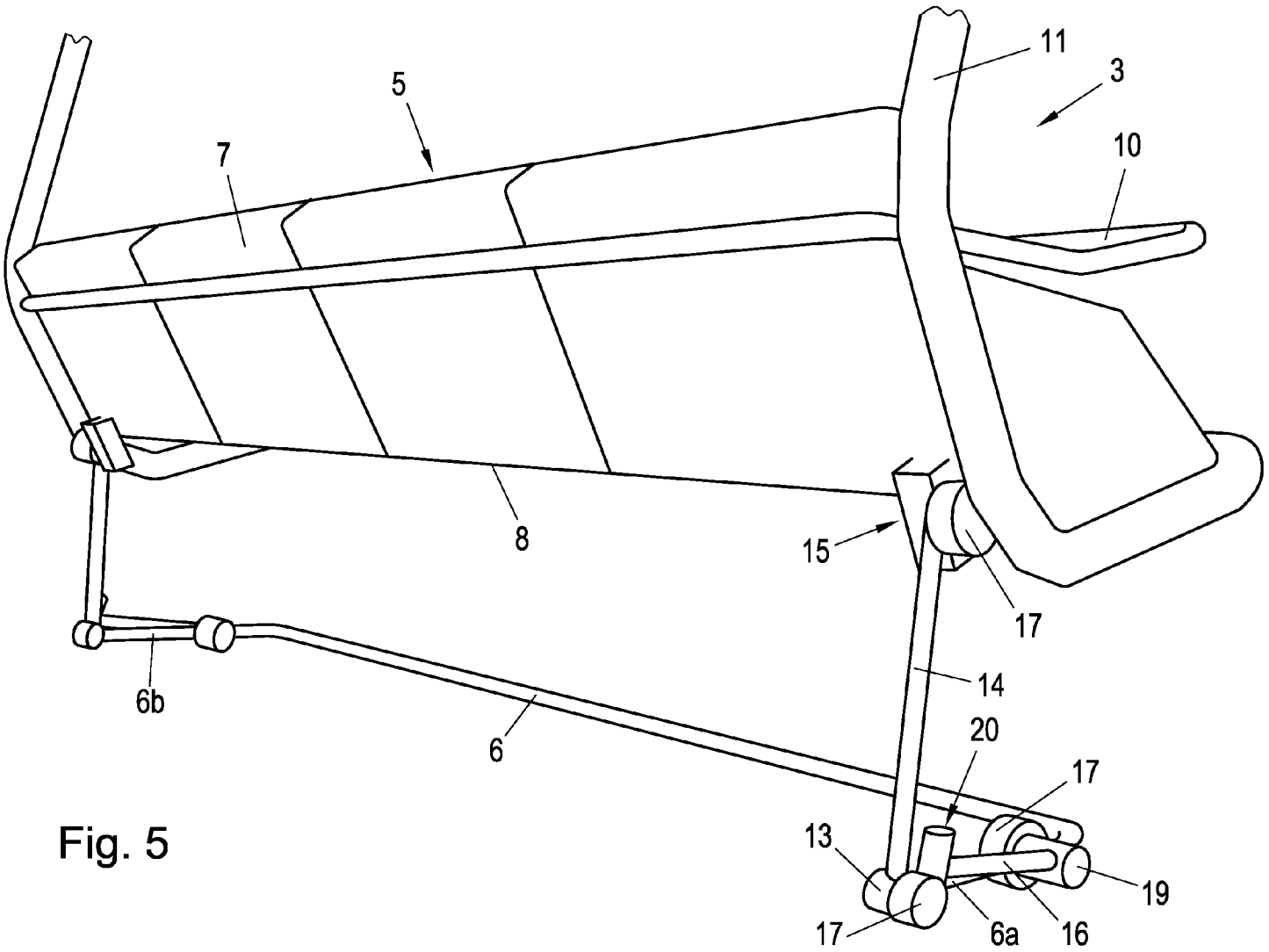

FIG. 4 shows a position similar to the positions shown in FIGS. 1B and 1D. In the region of this position the footrest 6 is in its lowest position and moves in a further sequence obliquely to the front and upward, so that from the rear and below it approaches the skis or snowboard of the passengers. The movement of the footrest 6 thus has a movement component which is oriented vertically upward and oriented horizontally to the front, before it reaches the travel position shown in FIG. 7.

Figure 6:
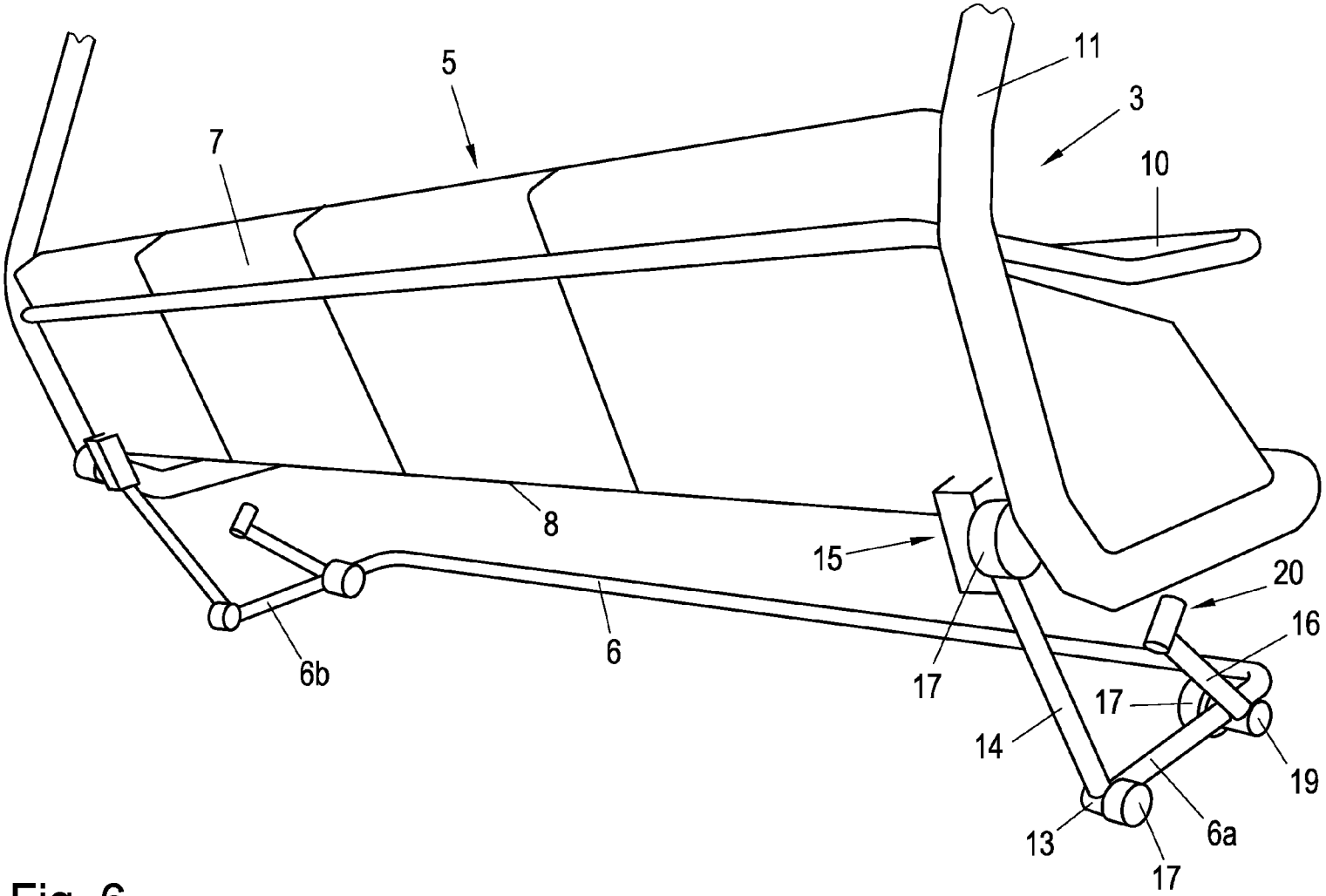

In FIG. 6 a position is shown in which the footrest 6 is already almost arranged in the travel position. The crossbeam serving as the footrest 6 is now arranged below the front edge 9 of the seat surface. In this position, the struts 16 have been pivoted out of their initial position via the joint 19 such that a free end 20 of the tension rod 16 approaches the front edge 9 of the seat surface. The pivoting of the struts is effected by the electric motors 19.

Figure 7:
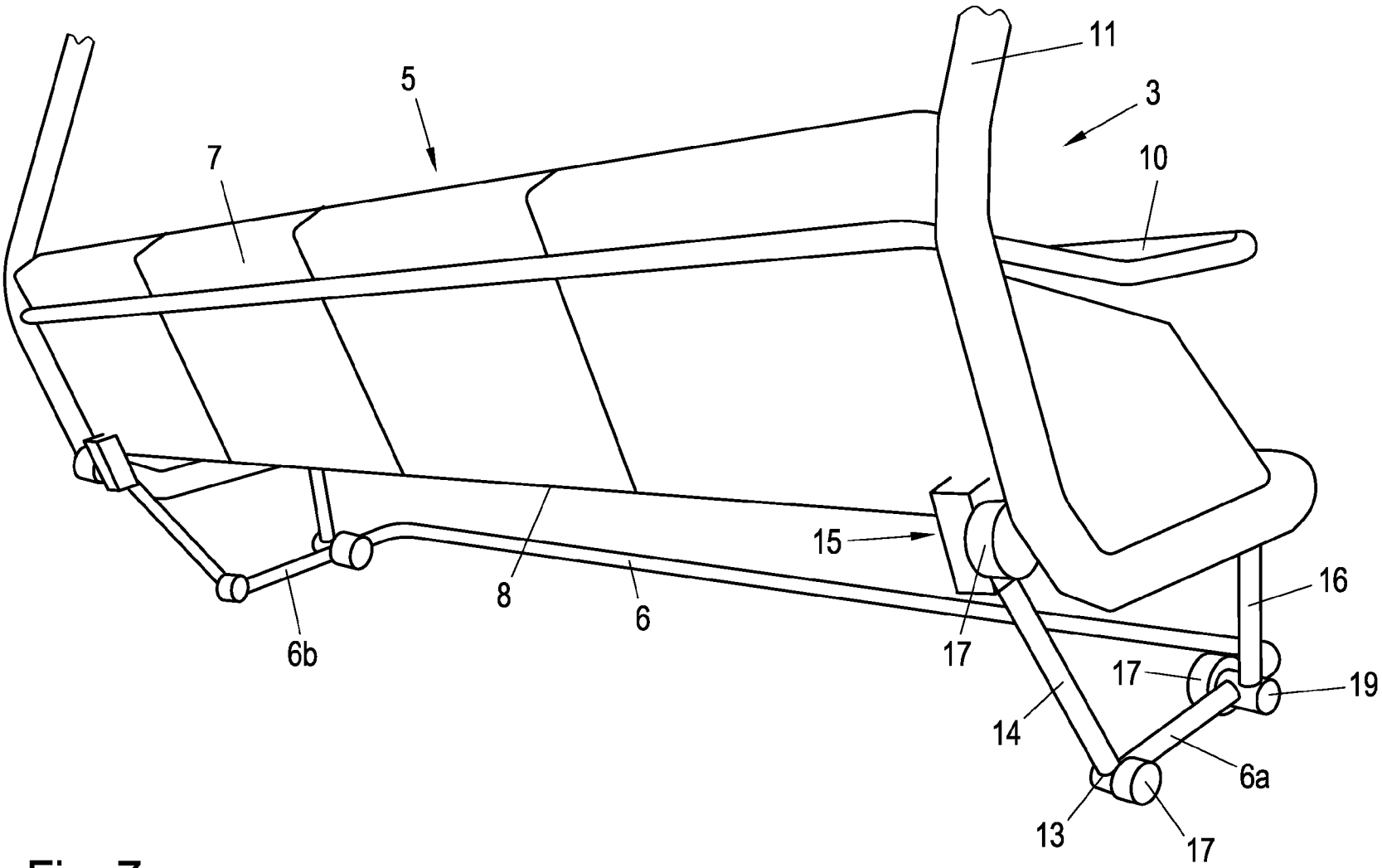
Figure 8:
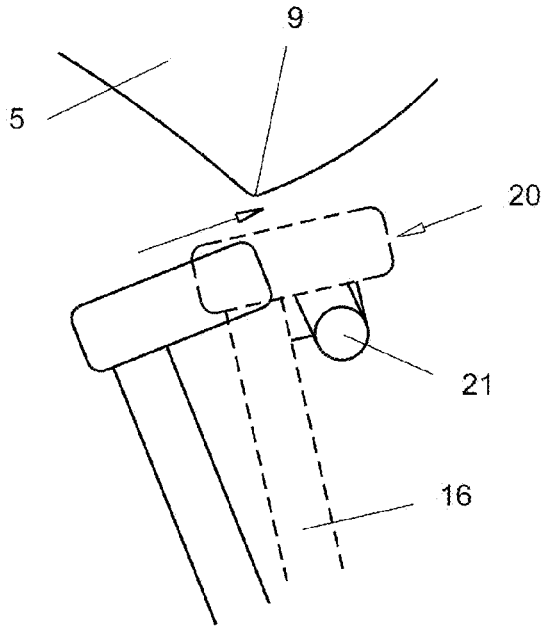
FIGS. 8 and 9 are illustrations showing a detailed view of struts of the footrest according to the invention.

In FIG. 7, the final travel position of the footrest 6 is shown similar to FIG. 1C. In this position, the crossbeam serving as the footrest 6 is arranged below the front edge 9 of the seat surface. The struts 16 are arranged at an angle of approximately 90° to the side parts 6*a*, 6*b*. In this travel position, the struts 16 are in their position of use in which their free ends 20 as shown in FIG. 8 are secured in the region of the front edge 9 of the seat surface, in order to hold the footrest 6. The chair 3 remains in the travel position shown in FIG. 7, during the entire journey from the first terminal 1 to the entrance region of the second terminal 2.

Figure 9:
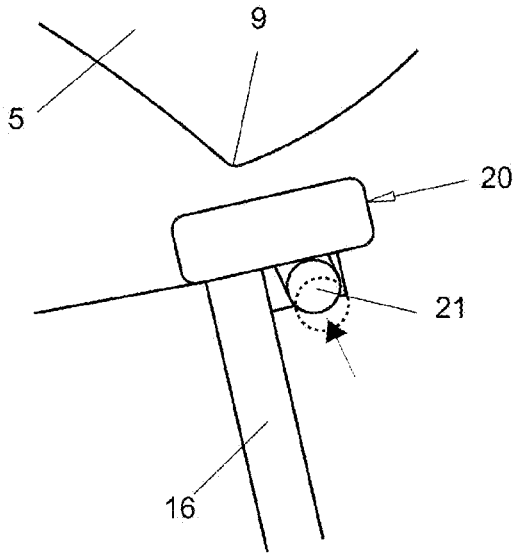

FIGS. 8 and 9 show a pin 21 arranged in the region of the front edge 9 of the seat surface and which may be displaced along its longitudinal axis. In the travel position of the footrest 6 the pin 21 secures a free end 20 of the tension rod 16 (FIG. 8), whereas it has been pulled back in the position shown in FIG. 9 and releases the free end 20 of the tension rod 16, so that the footrest 6 may be displaced into a boarding and/or disembarking position. Other ways of locking the struts 16 to a stable part of the chair are, however, naturally also possible.

When the free end 20 of the tension rod 16 is intended to be released, as in the entrance region of the second terminal 2 the footrest 6 is intended to be pivoted back from the travel position into the disembarking position, the pin 21 is pushed into the seat 5 so that the locking of the free end 20 of the tension rod 16 is released. Within the scope of the invention, the pin 21 may be displaced via the same tripping device as for the positioning of the footrest 6.

The pivoting of the footrest 6 from the travel position into the disembarking position takes place automatically by the positioning mechanism 17 and, similar to the previous embodiments, in the reverse manner.

Figure 10:
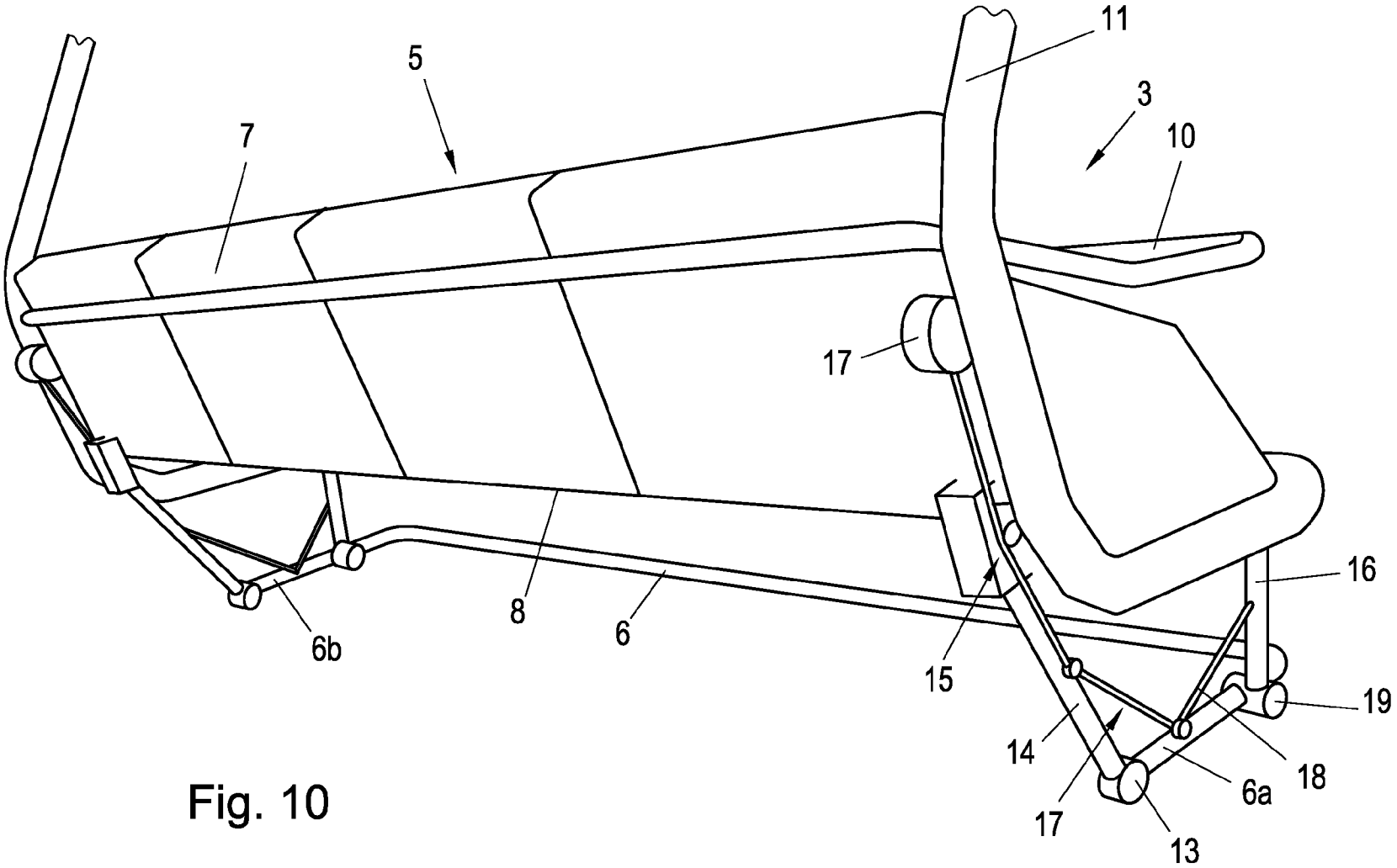
FIG. 10 is a perspective view of a further embodiment of the footrest according to the invention in the position according to FIG. 7.

In FIG. 10, a further embodiment of a footrest according to the invention is shown in the travel position. In this embodiment, the positioning mechanism 17, in addition to an electric motor arranged on the chair 3, additionally contains cables 18 which are arranged on the pivotable rods 14 on the side parts 6*a*, 6*b* and on the struts 16. By use of the cable 18, a tensile force is able to be exerted on the aforementioned components, whereby the positioning of the footrest 6 is assisted from the travel position into a boarding and/or disembarking position.

Figure 13:
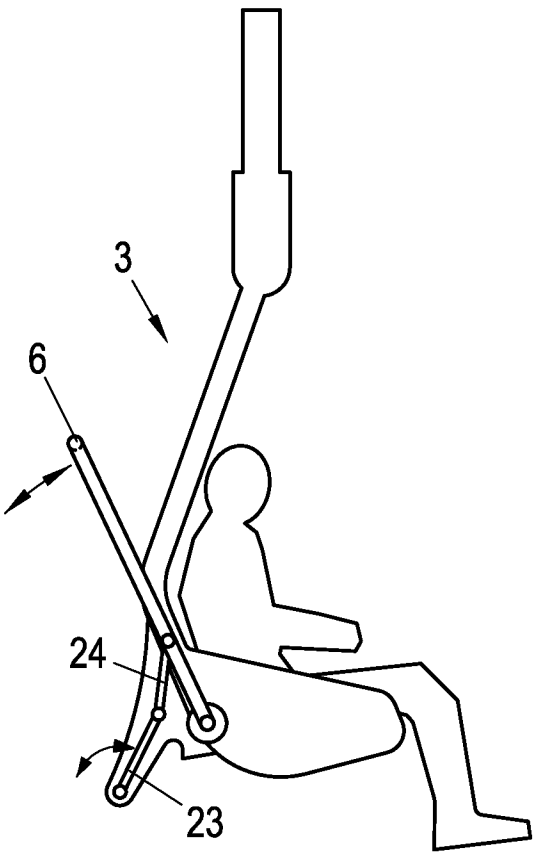
FIG. 13 is a side view showing the embodiment of FIG. 11 in a boarding and/or disembarking position.
Figure 12:
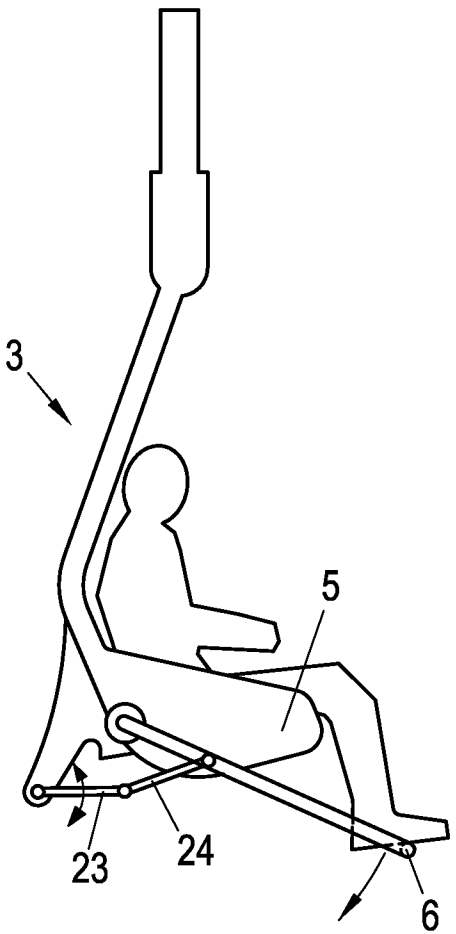
FIG. 12 is a side view showing the embodiment of FIG. 11 in an intermediate position.
Figure 11:
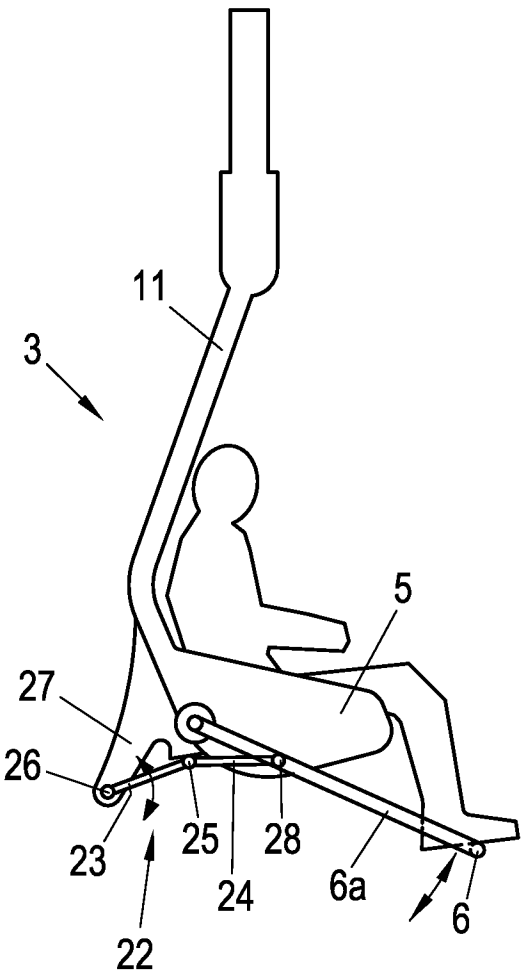
FIG. 11 is a side view showing a further embodiment of the footrest according to the invention in the travel position.

In FIGS. 11 to 13, a further embodiment of the invention is shown, in which the positioning mechanism 22 has a toggle lever with two lever arms 23, 24, which are connected together via a joint 25. One of the two lever arms 23 is connected in an articulated manner via a joint 26 to a component 27 fixed to the frame, and the other lever arm 24 to a side part 6*a*, 6*b* via a joint 28. On each side of the chair 3, a pair of two lever arms 23, 24 is arranged.

The end of the lever arm 23 assigned to the joint 26 is connected to a drive shaft which is not shown, and which may be driven by an electric motor arranged on the chair 3. Also, a different drive mechanism from that disclosed above may be provided for the lever arms 23.

In FIG. 11 the footrest 6 is shown in the travel position, in which a passenger may rest his/her feet with sports equipment optionally arranged thereon. The two levers 23 and 24 are located in a so-called locked position in which the joint 25 is not able to be moved further upward and, therefore, the lever 23 may not be rotated further counterclockwise. Preferably stops are arranged on the levers 23 and 24, the stops defining this locked position.

If such footrests 6 are moved from the travel position according to FIG. 11 into the boarding and/or disembarking position according to FIG. 13, the lever 23 is rotated clockwise, as visible in FIG. 12. By further rotation of the lever 23 the footrest 6 is pivoted via the second levers 24 into the position shown in FIG. 13.

For further pivoting of the footrest 6 into the travel position shown in FIG. 11, the lever 23 is pivoted from the position shown in FIG. 13 counterclockwise until it has reached the position shown in FIG. 11 again via the intermediate position shown in FIG. 12, in which the stops, not shown, come into abutment against one another and thus prevent further pivoting even when the passengers stand on the footrest 6.

As an alternative to the aforementioned stops, naturally other means may also be provided which prevent further pivoting of the levers 23, 24 beyond the position shown in FIG. 11.

According to the invention, the movement of the safety bar 10, may take place at the same time as, or chronologically offset from, the movement of the footrest 6. In particular, in a chronologically offset movement, the safety bar 10 may be closed first, followed by the movement of the footrest 6 out of the boarding and/or disembarking position into the travel position, whereas the footrest 6 may be moved from the travel position into the boarding and/or disembarking position before the safety bar 10 is opened.

The invention claimed is:

1. A chair of a chairlift, the chair comprising:
- at least one seat having a seat surface;
- a safety bar extending transversely over said seat and being pivoted from an open position into a closed position;
- an automatic positioning mechanism; and
- at least one footrest connected to said automatic positioning mechanism and being adjusted below said seat between a travel position and a boarding/disembarking position;
- pivotable rods, said footrest being coupled to said seat via said pivotable rods; and
- at least one tension rod for said footrest and disposed on at least one part of said footrest or said pivotable rods, in the travel position a free end of said tension rod being able to be fixed in a region of a front edge of said seat surface.

2. The chair according to claim 1, wherein before reaching the travel position, said footrest is configured to be moved with a movement which is oriented vertically upward.

3. The chair according to claim 2, wherein said footrest is configured to be moved from the boarding/disembarking position with a movement which is oriented vertically downward and which, toward the travel position, merges with a further movement which is oriented vertically upward.

4. The chair according to claim 1, wherein said automatic positioning mechanism is disposed on the chair and a tripping device is disposed in a region of a chairlift terminal.

5. The chair according to claim 1, further comprising a mechanism for opening and closing said safety bar, said automatic positioning mechanism is connected to said mechanism for opening and closing said safety bar.

6. The chair according to claim 1, wherein said seat surface has a front edge and a rear edge and in that said footrest in the travel position is disposed in a region below said front edge of said seat surface.

7. The chair according to claim 1, wherein said footrest is disposed at least one of in the boarding/disembarking position below said seat surface or in a region of a rear edge of said seat surface.

8. The chair according to claim 1, wherein:
- said seat has a backrest with a rear face; and
- said footrest is disposed in the boarding/disembarking position on said rear face of said backrest.

9. The chair according to claim 1, wherein said footrest is a crossbeam which extends at least partially over a width of said seat.

10. The chair according to claim 1, wherein said footrest is a crossbeam which extends substantially over a width of said seat.

11. The chair according to claim 1, further comprising a frame, said pivotable rods are connected to said frame.

12. The chair according to claim 1, further comprising an abutment, said free end of said tension rod in the travel position may be fixed to said abutment which may be displaced along its longitudinal axis.

13. The chair according to claim 1, wherein said automatic positioning mechanism is connected to said pivotable rods, to at least one part of said footrest and to said tension rod.

14. The chair according to claim 1, wherein said automatic positioning mechanism has at least one motor.

15. The chair according to claim 1, wherein said automatic positioning mechanism contains at least one of a cable or a rod arrangement.

16. The chair according to claim 1, further comprising a spring-loading device which is tensioned when moving said footrest from the travel position into the boarding/disembarking position.

17. The chair according to claim 1, further comprising a spring-loading device which is tensioned when moving said footrest from the boarding/disembarking position into the travel position.

18. The chair according to claim 14, wherein said at least one motor is an electric motor.

19. The chair according to claim 1,
- wherein the automatic positioning mechanism is also capable of pivoting said seat surface by a pivoting mechanism.

20. The chair according to claim 12, wherein said abutment is a pin which may be displaced along the longitudinal axis.

21. A method for operating a chairlift, which comprises the steps of:
- moving a chair having at least one seat with a seat surface from a first terminal to a second terminal;
- providing pivotable rods for coupling at least one footrest to the seat;
- pivoting a safety bar, in a region of the first and second terminals, between an open position and a closed position, and in the region of the first and second terminals the at least one footrest is positioned below the seat by an automatic positioning mechanism, between a travel position and a boarding/disembarking position; and
- providing least one tension rod for the at least one footrest and disposed on at least one part of the at least one footrest or the pivotable rods, in the travel position, fixing a free end of the tension rod in a region of a front edge of the seat surface.

22. The method according to claim 21, which further comprises before the travel position, moving the footrest with a movement which is oriented vertically upward.

23. The method according to claim 22, which further comprises after the boarding/disembarking position, moving the footrest with a movement which is oriented vertically downward and which, toward the travel position, merges with a movement which is oriented vertically upward.

24. The method according to claim 21, which further comprises providing the chair with an the automatic positioning mechanism, and in a region of a chairlift terminal the automatic positioning mechanism is tripped or driven by a tripping device.

25. The method according to claim 21, which further comprises driving the automatic positioning mechanism with a mechanism for opening and closing the safety bar or the automatic positioning mechanism is tripped.

26. The method according to claim 21, which further comprises, for the travel position, positioning the footrest in a region below a front edge of the seat surface and, for the boarding/disembarking position, positioning the footrest in a region of a rear edge of the seat surface.

27. The method according to claim 21, which further comprises positioning the footrest below the seat for the boarding/disembarking position.

28. The method according to claim 21, which further comprises positioning the footrest on a rear face of a backrest for the boarding/disembarking position.

29. The method according to claim 21, which further comprises tensioning a spring-loading device when the footrest is moved from the travel position into the boarding/disembarking position and the footrest is subsequently moved by the spring-loading device from the boarding/disembarking position into the travel position.

30. The method according to claim 21, which further comprises tensioning a spring-loading device when the footrest is moved from the boarding/disembarking position into the travel position, and the footrest is subsequently moved by the spring-loading device from the travel position into the boarding/disembarking position.

* * * * *